United States Patent [19]

Tata

[11] Patent Number: 4,645,432

[45] Date of Patent: Feb. 24, 1987

[54] MAGNETIC DRIVE VEHICLE COOLANT PUMP

[75] Inventor: Robert P. Tata, Huron, Ohio

[73] Assignee: General Motors Corporation, Detroit, Mich.

[21] Appl. No.: 829,305

[22] Filed: Feb. 14, 1986

[51] Int. Cl.[4] ..... F04B 17/00; F04B 35/04

[52] U.S. Cl. ..... 417/420; 415/10

[58] Field of Search ..... 417/420, 423 R, 362; 415/10, 122 R; 416/3; 310/104

[56] References Cited

U.S. PATENT DOCUMENTS

| | | | |
|---|---|---|---|
| 2,033,577 | 3/1936 | Hunter | 417/420 |
| 2,471,753 | 5/1949 | Johnston | 417/420 |
| 2,827,856 | 3/1958 | Zozulin | 417/420 |
| 2,939,974 | 6/1960 | Knight | 417/420 |
| 3,458,122 | 7/1969 | Andriussi | 416/3 |
| 3,627,445 | 12/1971 | Andriussi | 416/3 |
| 3,723,029 | 3/1973 | Laing | 417/420 |
| 3,732,445 | 5/1973 | Laing | 417/420 |
| 4,184,090 | 1/1980 | Taiani et al. | 417/420 |

*Primary Examiner*—Carlton R. Croyle
*Assistant Examiner*—Timothy S. Thorpe
*Attorney, Agent, or Firm*—Patrick M. Griffin

[57] ABSTRACT

A magnetic drive pump for use as a vehicle coolant pump. A fluid housing fixed to the engine block as an impeller mounted on the outside of a cylindrical support integrally stamped into a front wall of the housing. A pulley has a central hub that is rotatably mounted within the cylindrical support, coaxial with the impeller bearing. A web of the pulley and the impeller both face the housing front wall in closely spaced, parallel relation, with opposed matching magnetic drive elements. The structure is particularly simple and compact, and needs no cartridge or bearing seal.

3 Claims, 1 Drawing Figure

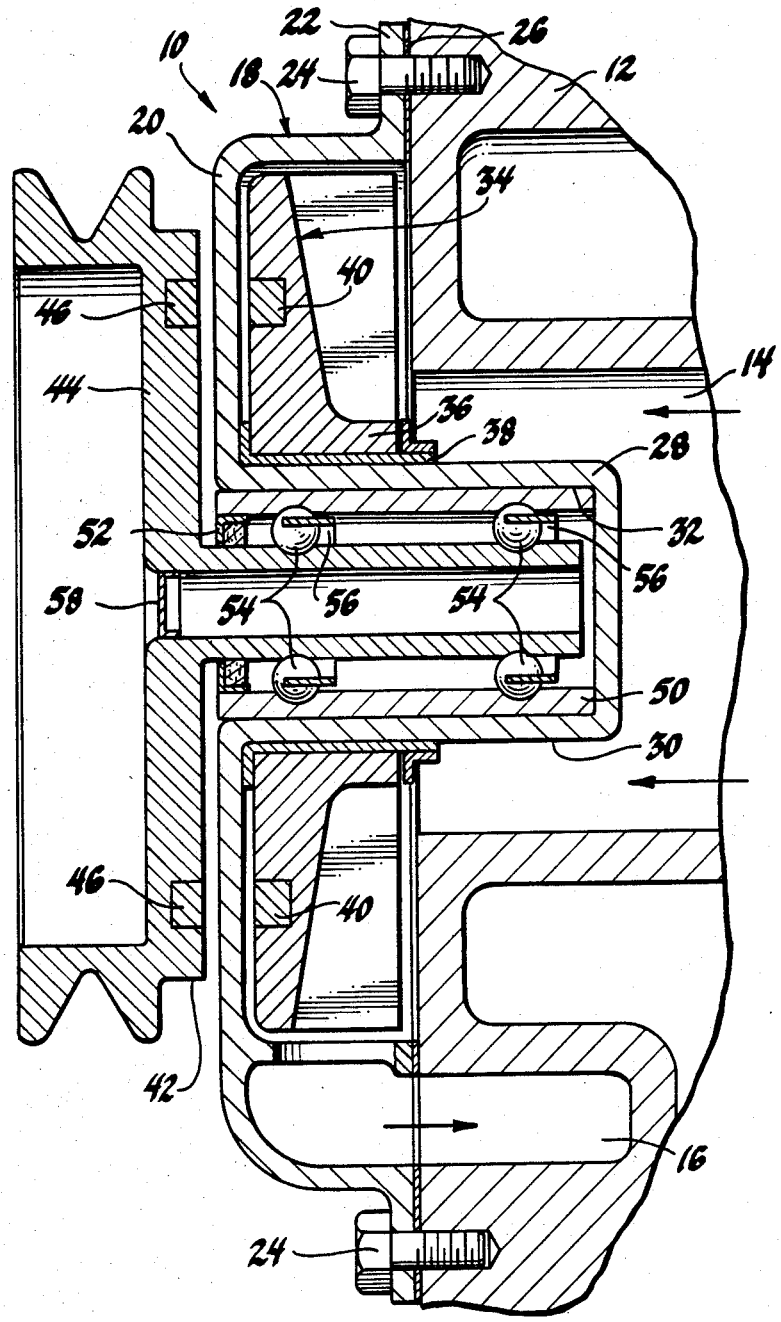
10
18
20
22
24
26
12
34
40
46
44
14
36
38
28
52
32
56
58
54
56
54
50
30
46
40
42
16
24

MAGNETIC DRIVE VEHICLE COOLANT PUMP

This invention concerns vehicle coolant pumps in general, and specifically a coolant pump that uses a magnetic drive so as to provide a particularly simple and axially compact design.

BACKGROUND OF THE INVENTION

Vehicle coolant pumps, often referred to as water pumps, are used to circulate coolant through the cooling passages of an engine block. They are generally operated by a driving member in the form of a pulley, which is in turn powered by a drive belt that runs off of the engine. It is necessary, of course, that the impeller of the pump be in communication with the coolant, in order to circulate it. The impeller is usually internal to a housing which is attached to the engine block and which encloses a space that communicates with the engine block cooling passages. A shaft or other member must be physically connected from the pulley to the impeller, which necessitates an opening physically through the housing. That opening must be sealed against the egress of coolant. The seal is highly stressed by the rapid rubbing rotation of the shaft that it surrounds, and by the heat of the coolant, coolant which may well contain abrasive particles, and will inevitably wear. The U.S. Pat. No. 3,632,220 to Lansinger et al illustrates well the problems with this conventional type of coolant pump. A generally cylindrical housing 9*a*, which stands out from the engine block 9, has a shaft 11 supported by a bearing 12 passing through it. The shaft 11 is sealed with a complex seal assembly, generally referred to as a cartridge seal, made up of two seal members 26 and 27 spring loaded against one another. Although it is not numbered, one skilled in the art will recognize a weep hole through the housing 9*a* opening to the ambient to vent the coolant that will invariably leak past the cartridge seal. In addition, a strong, and therefore highly frictional, bearing seal must be provided at the inner end of the bearing 12 to exclude leaking coolant from entering the bearing. Leaking coolant is the major cause of water pump bearing failure. It will also be noted that the pump disclosed is not particularly axially compact, as measured along the axis of the shaft 11. The housing 9*a* extends out from, not into, the engine block, and the bearing is spaced axially far away from the pump impeller 21. The complexity of the cartridge seal, as well as the necessity of venting the leaking coolant, all militate against making the pump more axially compact by moving the cartridge seal and bearing back inside the block, where they would not be so accessible or easily vented.

It is known, in general, to operate a pump impeller located on one side of a closure with a driver located on the other side of the closure by the use of opposed magnetic elements on the pump impeller and driver. This avoids passing a shaft physically through the closure, and thus no seal is necessary around the shaft. Numerous patents exist in the field of magnetic drive pumps, all of which incorporate the basic feature just described, with the consequent advantage of avoiding a seal. They are directed to various narrow and specific structures, none of which one skilled in the art could apply, without the application of inventive effort, to use as a vehicle coolant pump. Most involve very different environments and problems, such as pumps to be used with a large tank of corrosive chemicals, where space is not a critical factor.

For example, the U.S. Pat. No. 4,304,532 to McCry shows such a pump with an impeller 38 operated by a driver 20 which that is in turn powered by a shaft 18 from a motor 12. There are no particular space limitations in such an environment, and the motor 12 can be axially far removed from the impeller 38 with no problem. Such is not the case in the cramped environment where a vehicle coolant pump is to be used. More importantly, a vehicle coolant pump cannot be powered directly by a separate power source like a motor, but must be run indirectly from the vehicle engine with a belt and pulley. That pulley must be rotatably supported and axially and radially located relative to the pump impeller. The motor 12 in McCry is large and stable, and has its own internal bearings, so it is a simple matter to rotatably support the shaft 18 and driver 20 relative to the impeller 38. Similarly usable structure is just not available in the environment of a vehicle coolant pump. Other patents illustrate the same point. The U.S. Pat. No. 3,802,804 to Zimmermann shows another magnetic tank pump, again with a large motor 40 to support and locate a driver 38 relative to an impeller 35, all occupying a relatively large space in an environment where space is not a limitation. Other patents in the same field, such as the U.S. Pat. No. 4,115,040 to Knorr, do not disclose anything about bearings to support the driver and impeller, taking it as a given that there would be more than sufficient space and structure in the particular environment to provide them.

SUMMARY OF THE INVENTION

The subject invention provides a magnetic drive pump that is suitable for use as a vehicle coolant pump, thus eliminating the cartridge seal, and further provides such a pump that is particularly simple and axially compact.

The preferred embodiment of the coolant pump of the invention includes a fluid housing fixed to the engine block of a vehicle. The housing has a substantially planar front wall of non-magnetic material that encloses a space that is in communication with the cooling passages of the block. The front wall has an integral cylindrical support formed therein with its axis oriented substantially perpendicular to the front wall and extending into the interior of the fluid housing. The outer cylindrical surface of the cylindrical support, which is inside of the fluid housing and faces the coolant, is closed, and need not be sealed. The inner cylindrical surface opens out to the exterior of the fluid housing. A pump impeller inside the fluid housing has a central hub that coaxially surrounds the cylindrical support, and which is radially and axially supported on the outer surface thereof by by a flanged plain bearing. The impeller also has a magnetic portion that is thereby located closely facing and parallel to the inside of the front wall of the fluid housing.

A rotatable member, which, in the preferred embodiment is provided by a central hub that extends from the web of a driving pulley, is sized so as to fit coaxially within the cylindrical support of the fluid housing. The web of the pulley is substantially planar and generally perpendicular to its central hub, and includes a magnetic portion generally matching that of the impeller. In the preferred embodiment, the pulley hub actually fits within a cylindrical liner, which is in turn adapted to be press fitted within the inner surface of the fluid housing cylindrical support. Rolling bearing elements are disposed in the annular space between the pulley hub and the cylindrical liner to radially and axially support the pulley hub within the liner. Therefore, when the cylindrical liner with the rotatably supported pulley is press fitted within the cylindrical support, the planar web of the pulley is thereby located closely facing and parallel to the outside of the front wall of the fluid housing. The magnetic portions of the pulley web and impeller are thereby located in opposition to each other across the front wall. The pulley is thus able to magnetically drive the impeller when the pulley is rotated by the vehicle engine through a drive belt. A very simple structure is thus provided with no necessity of a cartridge seal, or for a seal to exclude leaking coolant from the bearing elements, or for weep holes to the ambient to vent leaking coolant. Furthermore, the particular spatial arrangement, with the pulley and impeller bearings located one within the other, and with the pulley web and impeller in closely facing opposition across the fluid housing front wall, gives a particularly axially compact unit. Several advantages, therefore, are cooperatively provided by the same structure.

It is, therefore, a broad object of the invention to provide a vehicle coolant pump that is magnetically driven, thus eliminating the cartridge seal, and to do so with a structure that is well suited to that specific environment, being particularly simple and axially compact.

It is another object of the invention to provide such a vehicle coolant pump structure in which a fixed fluid housing has a substantially planar wall of non-magnetic material with a cylindrical support extending from the fluid housing wall into the interior of the fluid housing and axially oriented substantially perpendicular to the housing wall, with a closed outer cylindrical surface inside of the fluid housing and an inner cylindrical surface opening to the exterior of the fluid housing, and in which a pump impeller inside the fluid housing coaxially surrounds and is radially and axially supported by the outer cylindrical surface of the cylindrical support, with the impeller having a magnetic portion that is thereby located closely facing and parallel to the inside of the fluid housing wall, and in which a rotatable member sized so as to fit coaxially within the cylindrical support and radially and axially supported by the cylindrical support inner surface has a driving member attached thereto, a driving member that has a substantially planar web located closely facing and parallel to the outside of the fluid housing wall with a magnetic portion of the web in opposition to the impeller magnetic portion so as to drive the impeller when the driving member rotates, the driving member, housing wall and pump impeller occupying a compact axial space by virtue of their relative location.

It is yet another object of the invention to provide such a vehicle coolant pump structure in which a rotatable driving member has a central cylindrical hub sized so as to fit coaxially within the fluid housing cylindrical support and radially and axially supported by the cylindrical support inner surface, so that a web of the driving member is thereby located closely facing and parallel to the outside of the fluid housing wall with its magnetic portion in opposition to the impeller magnetic portion so as to drive the impeller when the driving member rotates.

It is still another object of the invention to provide such a vehicle coolant pump structure in which the hub of the driving member fits within, and is radially and axially supported by bearing elements within, a cylindrical liner which is in turn adapted to be press fitted within the inner surface of the cylindrical support, whereby the cylindrical liner, with the rotatably supported driving member, may be press fitted within the fluid housing cylindrical support, thereby locating the planar web closely facing and parallel to the outside of the fluid housing wall with the magnetic portions of the impeller and pulley web in opposition.

DESCRIPTION OF THE PREFERRED EMBODIMENT

These and other objects and features of the invention will appear from the following written description and the drawing, which shows a cross section of the preferred embodiment in place on a portion of a vehicle engine block.

Referring to the drawing, the preferred embodiment of the subject invention, designated generally at 10, provides a magnetic drive pump that is suitable for use as a vehicle coolant pump, thus eliminating the main seal, and further provides such a pump that is particularly simple and axially compact. The coolant pump of the invention 10, is shown attached to a portion of a vehicle engine block, designated generally at 12. Engine block 12, as is typical, is cast with cooling passages, an inlet passage designated at 14 and an outlet passage designated at 16. Coolant flows through the passages 14 and 16, pumped by the coolant pump 10, as indicated by the arrows. The coolant pump 10 includes a fluid housing, designated generally at 18. Fluid housing 18 is stamped of aluminum or other suitable non-magnetic material, and includes a generally planar front wall 20 and a peripheral flange 22. When it is fixed with bolts 24 and a gasket 26 to block 12, fluid housing 18 encloses a space that is in communication with the cooling passages 14 and 16. That fixing does not occur until after other assembly steps described below have been completed, however. A cylindrical support, designated generally at 28, is integrally stamped into front wall 20 and extends inwardly therefrom with its axis generally perpendicular thereto. The outer cylindrical surface 30 of the cylindrical support 28, which is inside of the fluid housing 18 and faces the coolant, is closed, and need not be sealed. The inner cylindrical surface 32 opens out to the exterior of the fluid housing 18. A pump impeller, designated generally at 34, is located inside the fluid housing. Impeller 34 has a central hub 36 that coaxially surrounds the cylindrical support 28, and which is radially and axially supported on the outer cylindrical surface 30 thereof by a flanged plain bearing 38. The impeller 34 has a magnetic portion 40 that is thereby located closely facing and parallel to the inside of the front wall 20 of the fluid housing 18. Impeller 34 would not be added until after a prior step described below, however.

A driving member is provided by a pulley, designated generally at 42, which would be powered by a belt driven by the vehicle engine, not shown. Pulley 42 could be formed of 1070 steel or other suitable material, and includes a generally planar web 44 into which is set a magnetic portion 46 that generally matches the magnetic portion 40 of impeller 34. A rotatable member is provided by a central hub 48 that extends from the web 44, generally perpendicular thereto. Hub 48 is sized so as to fit coaxially within the fluid housing cylindrical support 28. In the preferred embodiment, the pulley hub 48 actually fits within a separate cylindrical liner 50 of bearing quality steel, which is in turn sized so that it can be press fitted within the inner cylindrical surface 32 of the cylindrical support 28, with an annular space therebetween.

The manufacturing and assembly process of the coolant pump 10 is as follows. Ball pathways are formed in the outer and inner surfaces respectively of hub 48 and liner 50, and induction hardened by conventional means. A dust seal 52 is pressed into one end of liner 50. Then, two rows of bearing balls 54 are placed in through the unobstructed right end of the annular space between liner 50 and hub 48. The balls 54 are conrad assembled between the pathways, and standard snap-in separators 56 added. This serves to radially and axially support the pulley hub 48 within the liner 50, and creates a separately handled subunit made up of the liner 50 and the pulley 42 rotatably supported thereto. Then, by heat expanding the cylindrical support 28, liner 50 may be press fitted easily thereinto. When the cylindrical liner 50 has been so assembled, the pulley web 44 is thereby located closely facing and parallel to the outside of the front wall 20 of the fluid housing 18. The plain bearing 38 and impeller 34 may then be added, and the impeller magnetic portion 40 will thereby be located in opposition to the pulley magnetic portion 46, facing it across the non-magnetic front wall 20. Finally, the fluid housing 18 is bolted in place as described above. A dust plug 58 may be added to the center hole of hub 48, if desired.

Once the above assembly steps are completed, it will be understood that pulley 42 will able to magnetically drive the impeller 34 when it is rotatably driven by the vehicle engine. The driven impeller 34 will circulate the coolant in the pattern shown by the arrows. The use of this indirect, magnetic drive makes several things possible. It allows for a very simple structure, compared to conventional, directly driven vehicle coolant pumps. No cartridge seal or tight bearing seal is necessary, giving a very low friction and low torque structure with almost no parts susceptible to wear or failure. Nor are weep holes opening to the ambient out of the housing necessary. Eliminating these conventional items allows the pulley bearings 54 to be moved axially inboard, inside of and occupying essentially the same axial space as the impeller bearing 38. This gives a highly axially compact unit, which is very advantageous in the cramped environment of increasingly smaller cars. Alternatively, the particular compact spatial arrangement may be thought of as serving to bring the pulley web 44 and impeller 34 into sufficiently closely facing relation to allow the matching magnetic portions 46 and 40 to operate. However the invention is conceptualized, it is apparent that a number of advantages cooperatively flow from a very simple and tightly interacting structure.

Variations of the preferred embodiment disclosed may be made within the sprit of the invention. For example, a separate shaft could replace the hub 48, with a pulley attached separately to it, although that would mean more total parts. While the integral ball pathways on the hub 48 are practical, a separable raceway could be used instead, if desired. Or, it is possible that an integral ball pathway could be formed on the inner surface of support 28, as well as on the hub 48, especially if the pulley 42 were made separable from its hub 48. This would allow conrad assembly of the balls directly into the cylindrical support 28 from the left end of the annular space. This would eliminate the liner 50, but the liner 50 is desirable since support 28 is unlikely to be formed of bearing quality material. It is also advantageous to have the easily handled subunit comprised of pulley 42 and liner 50, as described. Bearing elements other than balls 54 could be used, as well, although balls are particularly easy to assemble in the environment disclosed. Therefore, it will be understood that it is not intended to limit the scope of the invention to just the preferred embodiment disclosed.

The embodiments of the invention in which an exclusive property or privilege is claimed are defined as follows:

1. An axially compact magnetic drive pump for use as a vehicle coolant pump, comprising, a fixed fluid housing having a substantially planar wall of non-magnetic material with a cylindrical support extending from said fluid housing wall into the interior of said fluid housing, said cylindrical support having its axis oriented substantially perpendicular to said housing wall and having a closed outer cylindrical surface inside of said fluid housing and an inner cylindrical surface opening to the exterior of said fluid housing, a pump impeller inside said fluid housing coaxially surrounding and radially and axially supported by the outer cylindrical surface of said cylindrical support, said impeller having a magnetic portion that is thereby located closely facing and parallel to the inside of said fluid housing wall, a rotatable member sized so as to fit coaxially within said fluid housing cylindrical support and radially and axially supported by said cylindrical support inner surface, and, a driving member having a substantially planar web with a magnetic portion, said driving member being attached to said rotatable member so that said planar web is located closely facing and parallel to the outside of said fluid housing wall with its magnetic portion in opposition to said impeller magnetic portion so as to drive said impeller when said driving member rotates, said driving member, housing wall and pump impeller occupying a compact axial space by virtue of their relative location.

2. An axially compact magnetic drive pump for use as a vehicle coolant pump, comprising, a fixed fluid housing having a substantially planar wall of non-magnetic material with a cylindrical support extending from said fluid housing wall into the interior of said fluid housing, said cylindrical support having its axis oriented substantially perpendicular to said housing wall and having a closed outer cylindrical surface inside of said fluid housing and an inner cylindrical surface opening to the exterior of said fluid housing, a pump impeller inside said fluid housing coaxially surrounding and radially and axially supported by the outer cylindrical surface of said cylindrical support, said impeller having a magnetic portion that is thereby located closely facing and parallel to the inside of said fluid housing wall, and, a rotatable driving member having a central cylindrical hub sized so as to fit coaxially within said fluid housing cylindrical support and radially and axially supported by said cylindrical support inner surface, said driving member also having a substantially planar web with a magnetic portion that is thereby located closely facing and parallel to the outside of said fluid housing wall with its magnetic portion in opposition to said impeller magnetic portion so as to drive said impeller when said driving member rotates, said driving member, housing wall and pump impeller occupying a compact axial space by virtue of their relative location.

3. An axially compact magnetic drive pump for use as a vehicle coolant pump, comprising, a fixed fluid housing having a substantially planar wall of non-magnetic material with a cylindrical support extending from said fluid housing wall into the interior of said fluid housing, said cylindrical support having its axis oriented substantially perpendicular to said housing wall and having a closed outer cylindrical surface inside of said fluid housing and an inner cylindrical surface opening to the exterior of said fluid housing, a pump impeller inside said fluid housing coaxially surrounding and radially and axially supported by the outer cylindrical surface of said cylindrical support, said impeller having a magnetic portion that is thereby located closely facing and parallel to the inside of said fluid housing wall, a cylindrical liner adapted to be press fitted within the inner surface of said cylindrical support, a driving member having a central cylindrical hub sized so as to fit coaxially within said cylindrical liner and annularly spaced therefrom, said driving member also having a substantially planar web with a magnetic portion, and, rolling bearing elements disposed in said annular space to radially and axially support said driving member hub coaxially within said cylindrical liner, whereby said cylindrical liner with said driving member rotatably supported therein may be press fitted within said fluid housing cylindrical support, thereby locating said planar web closely facing and parallel to the outside of said fluid housing wall with its magnetic portion in opposition to said impeller magnetic portion so as to drive said impeller when said driving member rotates, said driving member, housing wall and pump impeller occupying a compact axial space by virtue of their relative location.

* * * * *